US011623845B2

(12) United States Patent
Studer et al.

(10) Patent No.: US 11,623,845 B2
(45) Date of Patent: Apr. 11, 2023

(54) ELEVATOR SYSTEM

(71) Applicant: Inventio AG, Hergiswil (CH)

(72) Inventors: Christian Studer, Kriens (CH); Donato Carparelli, Lugano (CH); Josef Husmann, Lucerne (CH); Raphael Bitzi, Ebikon (CH)

(73) Assignee: INVENTIO AG, Hergiswil (CH)

( * ) Notice: Subject to any disclaimer, the term of this patent is extended or adjusted under 35 U.S.C. 154(b) by 550 days.

(21) Appl. No.: 16/634,198

(22) PCT Filed: Jul. 25, 2018

(86) PCT No.: PCT/EP2018/070099

§ 371 (c)(1),
(2) Date: Jan. 27, 2020

(87) PCT Pub. No.: WO2019/034381

PCT Pub. Date: Feb. 21, 2019

(65) Prior Publication Data

US 2020/0180911 A1 Jun. 11, 2020

(30) Foreign Application Priority Data

Aug. 17, 2017 (EP) ..... 17186585

(51) Int. Cl.
*B66B 9/00* (2006.01)
*B66B 11/00* (2006.01)

(52) U.S. Cl.
CPC ..... *B66B 9/003* (2013.01); *B66B 11/0095* (2013.01); *B66B 2201/30* (2013.01)

(58) Field of Classification Search
CPC . B66B 9/003; B66B 11/0095; B66B 2201/30; B66B 7/06; B66B 7/08; B66B 7/085; F16G 3/00
See application file for complete search history.

(56) References Cited

U.S. PATENT DOCUMENTS 3,910,383 A 10/1975 Friedli
7,469,774 B2 * 12/2008 Ach ..... B66B 7/085 24/115 M (Continued)

FOREIGN PATENT DOCUMENTS

CN 100460302 C 2/2009
CN 101896416 A 11/2010

(Continued)

OTHER PUBLICATIONS

Machine translation of the description of EP 1693331 A1, Aug. 23, 2006 (Year: 2006).*

*Primary Examiner* — Michael R Mansen
*Assistant Examiner* — Michelle M Lantrip
(74) *Attorney, Agent, or Firm* — William J. Clemens; Shumaker, Loop & Kendrick, LLP

(57) ABSTRACT

An elevator system includes an elevator car that is movable in an elevator shaft in the vertical direction, a closed support belt guided about a lower deflection roller and an upper deflection roller and a drive machine driving the support belt. A drive connection is made between the support belt and the elevator car with a coupling device arranged on the elevator car that is coupled to a coupling element of the support belt. The coupling element is a connection element that connects two free ends of the support belt together.

13 Claims, 5 Drawing Sheets

(56) References Cited

U.S. PATENT DOCUMENTS

| | | | | |
|---|---|---|---|---|
| 9,132,991 | B2 * | 9/2015 | Husmann | B66B 11/022 |
| 9,248,994 | B2 * | 2/2016 | Grundmann | B66B 9/003 |
| 9,758,347 | B2 * | 9/2017 | Dudde | B66B 9/00 |
| 2008/0142308 | A1 | 6/2008 | Kocher | |
| 2011/0024239 | A1 * | 2/2011 | Kocher | B66B 11/0095 187/249 |
| 2014/0291074 | A1 * | 10/2014 | Bjorni | B66B 9/00 187/249 |
| 2016/0244299 | A1 | 8/2016 | Zerelles et al. | |
| 2016/0251202 | A1 * | 9/2016 | Müller | B66B 9/00 187/249 |
| 2017/0267490 | A1 * | 9/2017 | Haapaniemi | B66B 11/005 |
| 2021/0147183 | A1 * | 5/2021 | Dietze | B66B 5/005 |

FOREIGN PATENT DOCUMENTS

| | | | | |
|---|---|---|---|---|
| CN | 104837759 | A | 8/2015 | |
| EP | 1634842 | A2 | 3/2006 | |
| EP | 1647513 | A2 * | 4/2006 | B66B 11/0095 |
| EP | 1693331 | A1 | 8/2006 | |
| EP | 1935827 | A1 * | 6/2008 | B66B 11/0065 |
| EP | 2070860 | A1 * | 6/2009 | B66B 9/00 |
| EP | 2219985 | B1 | 2/2013 | |
| JP | 03177293 | A * | 8/1991 | B66B 5/0031 |
| JP | 09030756 | A * | 2/1997 | B66B 9/00 |
| JP | H0930756 | A | 2/1997 | |
| JP | H09194159 | A | 7/1997 | |
| JP | H1059659 | A | 3/1998 | |
| JP | 2000086121 | A | 3/2000 | |
| JP | 2005132527 | A | 5/2005 | |
| JP | 2005200162 | A | 7/2005 | |
| JP | 4552793 | B2 | 9/2010 | |
| JP | 2012246116 | A | 12/2012 | |
| WO | 2010072656 | A1 | 7/2010 | |
| WO | WO-2011161104 | A1 * | 12/2011 | B66B 5/0031 |
| WO | WO-2015013684 | A2 * | 1/2015 | B66B 1/2433 |
| WO | WO-2015043765 | A1 * | 4/2015 | B66B 11/0095 |

* cited by examiner 10
30, 34b
69
12
13
16
CAR
22
44.1b
26b
CAR
14
18
44.2b
28

10
70
14
22
74
72
24
76
18
16
74
74 BRAKING DEVICE 10
22
44.2b
14
44.2b
16
18
44.1b
44.1b

ELEVATOR SYSTEM

FIELD

The invention relates to an elevator system having an elevator car moved in an elevator shaft by a drive machine and a closed support means guided about a lower deflection roller and an upper deflection roller. A coupling device provides a drive connection between the support means and the elevator car.

BACKGROUND

WO 2010/072656 A1 describes an elevator system comprising two elevator cars which can be moved in an elevator shaft in the vertical direction, wherein each elevator car is connected to a counterweight by means of a supporting and propulsion means in the form of a steel cable. The elevator system has two drive machines in the form of electric motors, each of which can drive a propulsion disk, which in each case guides one supporting and propulsion means. Thus, the two elevator cars can be moved independently from one another by the drive machines in the elevator shaft. The cross section of the elevator shaft must therefore be designed such that the counterweights can be guided past the elevator cars.

EP 2219985 B1 describes an elevator system comprising two elevator cars which can be moved in an elevator shaft in the vertical direction, a closed support means which is guided about a lower deflection roller and an upper deflection roller, a drive machine in the form of an electric motor which is paired with the support means, and a controllable coupling device arranged on each of the elevator cars. The support means has a plurality of coupling elements, which, for example, can be designed as holes or cams. A coupling device of an elevator car can be coupled to and decoupled from a coupling element; as a result, a drive connection between the respective elevator car and the support means can be produced and detached. An elevator car coupled to a support means can thus be moved in the first elevator shaft by means of the support means drivable by the respective drive machine.

In said elevator shaft, the elevator cars are moved in only one direction, i.e., only upwards or only downwards. In order to be able to realize a continuing operation of the elevator cars, the elevator system has a further elevator shaft. By means of a transfer device, the elevator cars can be displaced horizontally between the two elevator shafts. During operation of the elevator system, an elevator car is coupled to a support means at a lower or an upper end position via its coupling device and a coupling element, and via the support means, it is moved upwards or downwards by the associated drive machine until it reaches the upper or lower end position. There, the elevator car is decoupled from the support means and is horizontally displaced to the other elevator shaft by a transfer device to the elevator shaft for the other movement direction.

SUMMARY

In contrast, the invention particularly addresses the problem of proposing an elevator system which requires only little space in a building and allows for a simple and thus cost-effective realization of the support means.

The elevator system according to the invention has a first elevator car which can be moved in a first elevator shaft in the vertical direction. It further comprises a closed first support means which is guided about a lower deflection roller and an upper deflection roller and a first drive machine which is paired with the first support means. The first support means has a first primary coupling element which can be coupled to a first coupling device arranged on the first elevator car. Thus, a drive connection between the first elevator car and the first support means can be produced, and so the coupled first elevator car can be moved in the first elevator shaft by means of the first support means drivable by the first drive machine. According to the invention, the first primary coupling element of the first support means is designed as a connection element which connects two free ends of the first support means together.

The use of a closed support means makes it possible to dispense with a counterweight which must be guided past the elevator car, thus allowing for a small cross section of the elevator shaft. In addition, said coupling element fulfills a dual function. It is used to couple the elevator car to the support means and for the simple and cost-effective realization of the closed support means.

The coupling element fulfills particularly the function of a so-called belt fastener or a cable connector. As a result, a closed support means can be produced in a very simple, cost-effective, and safe manner from an originally open, elongated support means by connecting the two free ends to the coupling element. For example, the coupling element can comprise two interconnected support means end connections which, for example, can be designed according to EP 1634842 A2. The two support means end connections can be connected, for example, via an intermediate piece, with which, e.g., they can be screwed or welded together. The coupling element can also have a one-piece housing.

The elevator shaft is arranged in or on a building and runs mainly in the vertical direction, and so the elevator cars are moved mainly vertically when moved in the elevator shaft.

The support means is closed, i.e., designed, for example, in an annular manner. It can thus also be called endless. However, this does not mean that it is designed as a homogeneous ring or only as one piece. Instead, the ring is realized by connecting two free ends of support means parts by means of the coupling element designed as a connection element. The support means is guided about a lower and an upper deflection roller, wherein at least one deflection roller serves as a drive roller or propulsion disk, by means of which the support means can be driven by the associated drive machine. The deflection rollers particularly have an effective diameter of less than 100 mm. Such small effective diameters of a deflection roller serving as a propulsion disk allow for a gearless drive of the support means, which takes up little installation space. The deflection rollers are particularly arranged such that their respective rotational axis is perpendicular to an adjacent shaft wall of the elevator shaft. On the support means, particularly a tensioning device can be arranged, with which the required support means pretension is generated, and deviations in the initial length of the closed support means as well as operational plastic changes in length of the support means are compensated. The required tensioning forces can be generated, for example, with tension weights, gas springs, or metal springs.

The drive machine is designed particularly as an electric motor which is controlled by an elevator controller. The elevator controller controls the complete operation of the elevator system, i.e., it controls all controllable components of the elevator system and is connected to switches and sensors of the elevator system. The elevator controller can be designed as a single central elevator controller or consist of several decentralized controllers which are responsible for subtasks.

The coupling device arranged on the elevator car is arranged particularly on a floor or a roof of the elevator car. The coupling to a coupling element of the support means takes place particularly in an interlockingly connected manner, wherein a frictionally engaged coupling is also conceivable. The coupling element has particularly a mainly horizontally oriented recess, into which, for example, a bolt of the coupling device can be inserted in an actuation direction. In the simplest case, the coupling element can be screwed to the elevator car. In this case, the coupling device is designed as one or more screws. The coupling device and the coupling element can thus be used to produce an interlocking or frictionally engaged connection between the elevator car and the support means, and so the elevator car is moved when the propulsion means is moved. As a result, a drive connection between the elevator car and the support means and therefore ultimately between the elevator car and the drive machine associated with the support means can be produced.

In an embodiment of the invention, the first coupling device is coupled to the first primary coupling element such that, during a normal operation of the elevator system, the first coupling device cannot be decoupled from the first primary coupling element. Therefore, during normal operation, there is always a drive connection between the first elevator car and the first support means. As a result, the first elevator car is moved exclusively in the first elevator shaft. This allows for a particularly simple design of the elevator system. In this embodiment, a support means of the elevator system has exactly one coupling element.

Normal operation of the elevator system refers to an operating mode, in which passengers are transported in the elevator car. The normal operation must be particularly distinguished from a maintenance phase, in which a maintenance engineer can perform maintenance on the elevator system; from an installation phase, in which the elevator system is installed; and from a disassembly phase, in which the elevator system is disassembled. In said three phases, it is possible that the coupling of the first coupling device with the first primary coupling element is disengaged. The coupling device is coupled to the coupling element particularly in the installation phase and possibly in the maintenance phase, but not during normal operation of the elevator system.

In an embodiment of the invention, the first coupling device can be controlled such that during normal operation of the elevator system, the first coupling device can be coupled to the first primary coupling element and decoupled from the first primary coupling element. As a result, a drive connection between the first elevator car and the first support means can be produced and detached. If the elevator car is decoupled from the support means, it can be moved out of the first elevator shaft and displaced, for example, to a second elevator shaft. The elevator system is thus particularly flexible.

An elevator system with a firm connection between the first elevator car and the first support means during normal operation has particularly at least one second elevator car which is also moved only in the first elevator shaft. In such case, the connection between the second elevator car and the second support means is particularly identical to that of the first car. The two elevator cars can also be moved independently of one another. As a result, a very high transport capacity of the elevator system can be achieved in terms of space requirements. The elevator system can particularly also have more than two, for example, three or four elevator cars.

An elevator system with a detachable connection between the first elevator car and the first support means during normal operation has particularly at least one second elevator car which can also be displaced to a second elevator shaft. The coupling and decoupling of the second elevator car to and from the second support means is carried out particularly in the same manner as for the first elevator car. The two elevator cars can also be moved independently of one another. As a result, a very high transport capacity of the elevator system can be achieved in terms of space requirements. The elevator system can particularly also have more than two, for example, three or four elevator cars. The coupling devices are particularly controlled such that, at least during the movement of an elevator car, only one elevator car is coupled to a (single) support means. Therefore, only one (single) elevator car at a time is moved in the shaft by a (single) support means.

If more than one support means is present, it may be necessary for the coupling devices to be able to couple to the coupling elements of the different support means. In such case, the coupling devices are arranged horizontally, particularly transversely to their actuation direction. If an elevator car is supposed to be coupled to a support means, the coupling device is moved transversely to its actuating direction such that it is correctly positioned with respect to the coupling element of the corresponding support means. Subsequently, the support means can be coupled particularly by extending a bolt of the coupling element. For this case, it is also possible that, per support means, a correspondingly positioned coupling device is provided on the elevator car.

Even if a plurality of support means is present, one coupling device in a fixed position, i.e., one non-displaceable coupling device, can be sufficient per elevator car. This requires an assignment of an elevator car to a coupling element, which shall be described in more detail below.

For the realization of an elevator system with more than one elevator car, the elevator systems have a second elevator car which is movable in the vertical direction in the first elevator shaft, a closed second support means which is guided about a lower deflection roller and an upper deflection roller, and a second drive machine which is paired with the second support means. A second coupling device is arranged on the second elevator car. The second support means has a second primary coupling element which can be coupled to the second coupling device; as a result, a drive connection between the second elevator car and the second support means can be produced. The coupled second elevator car can thus be moved in the first elevator shaft by means of the second support means drivable by the second drive machine. As a result, it is possible to operate the elevator system particularly effectively, and many passengers, particularly with different destination floors in the building, can be transported. The elevator system can also have more than two, particularly four, six, or eight support means per elevator shaft, and so four, six, or eight elevator cars can also be moved in an elevator shaft simultaneously and independently of one another.

In an embodiment of the invention, the support means, in addition to said primary coupling element, have a secondary coupling element, to and from which coupling devices can be coupled and decoupled, respectively. The primary and secondary coupling elements of a support means are arranged such that, in case of a movement of an elevator car, which is coupled to a support means via a coupling element, from a lower end position to an upper end position, or vice versa, no coupling element is guided about a deflection roller. The primary and secondary coupling elements are designed to be particularly identical.

In case of the aforementioned movement of the elevator car between the two end positions, i.e., at a maximum movement in the elevator shaft, no coupling element is thus guided about or over one of the deflection rollers. As a result, only the flexible support means is guided over the deflection rollers, which is possible without loss of comfort, such as jerking or noise generation. In addition, with regard to the design of the coupling elements, it can be neglected whether they are at all guided about or over the deflection rollers, or whether they can be guided about or over the deflection rollers with the least possible loss of comfort. The coupling elements can thus be optimally adapted to their tasks, i.e., to allow for the coupling of the coupling device to a support means and to connect two free ends of the support means. In addition, in the area of the deflection rollers, no installation space must be provided, in which the coupling elements can be guided about the deflection rollers. This allows for a simpler design of the elevator system.

In this case, the support means thus consists of two support means parts, whose free ends are connected by means of a primary coupling element and a secondary coupling element. In such case, each of the free ends of the first support means part is connected to a free end of the second support means part, and so the support means forms a closed ring.

This arrangement of the coupling elements on a support means makes it possible to control the drive machine associated with the support means such that, during the operation of the elevator system, no coupling element is ever guided about a deflection roller.

Said first and second elevator car do not have to be moveable simultaneously in the first elevator shaft. It is particularly possible that at first, the first elevator car is moved in the elevator shaft and subsequently, the second elevator car is moved particularly in the same direction in the elevator shaft. For this purpose, the first elevator car is removed from the elevator shaft particularly before or during the movement of the second elevator car.

In an embodiment of the invention, the two coupling elements of the support means are arranged such that in a movement of the first elevator car, which is coupled to the support means via a coupling element, from a lower end position to an upper end position, or vice versa, no coupling element comes into contact with a deflection roller. In other words, the coupling element does not touch the deflection rollers. As a result, no deflection roller can be damaged by a coupling element, or vice versa.

This arrangement of the coupling elements on a support means makes it possible to control the drive machine associated with the support means such that, during the operation of the elevator system, no coupling element ever comes into contact with a deflection roller. The support means can thus always be stopped in time such that the coupling elements never reach the deflection rollers or, for example, maintain a specific minimum distance to the deflection rollers.

In an embodiment of the invention, the two coupling elements of the support means are arranged such that, when an elevator car, which is coupled to a support means via a primary coupling element, has reached the upper end position, the secondary coupling element is positioned such that a coupling device of an elevator car arranged in the lower end position can couple to the secondary coupling element. In the case of a downward movement of an elevator car, the secondary coupling element, upon the first elevator car reaching the lower end position, is correspondingly positioned such that a coupling device of an elevator car arranged in the upper end position can couple to the other coupling element. Therefore, whenever the first elevator car has reached one of the two end positions, another elevator car at the other end position can couple to the secondary coupling element and thus prepare the movement of the other elevator car. As a result, the decoupling of an elevator car and the coupling of another elevator car can take place, at least to some extent, simultaneously, thus allowing for an effective operation of the elevator system.

In an embodiment of the invention, the drive machines are controlled by an elevator controller. It is provided to reverse a movement direction of the support means for the next movement of an elevator car when an elevator car, depending on the movement direction, has reached the lower end position or the upper end position. It is thus advantageously possible to move both elevator cars of the elevator system in the same direction in the elevator shaft without a coupling element being guided about a deflection roller or coming into contact with a deflection roller during the operation of the elevator system. The elevator controller is thus provided to move the elevator cars in the elevator shaft only in one direction, i.e., only from the bottom to the top or only from the top to the bottom.

In an embodiment of the invention, the first and the second elevator car can also be moved in a vertical direction in a second elevator shaft arranged parallel to the first elevator shaft. The elevator system also comprises a first transfer device, by means of which elevator cars can be displaced from the first elevator shaft to the second elevator shaft, and a second transfer device, by means of which elevator cars can be displaced from the second elevator shaft to the first elevator shaft. A movement of the elevator cars in the second elevator shaft is realized analogously to the movement in the first elevator shaft. In the first elevator shaft, the elevator cars are moved only from the bottom to the top, and in the second elevator shaft only from the top to the bottom. In this case, it is not relevant which elevator shaft is denoted as the first elevator shaft and which is denoted as the second elevator shaft.

In this context, an analogous realization of the movement of the elevator cars in the elevator shaft is supposed to refer to the fact that at least one support means with a correspondingly arranged primary and secondary coupling element is also provided in the second elevator shaft, and which can be driven via an associated drive machine. In addition, all the above-mentioned embodiments of the invention are also applicable to the second elevator shaft.

The provision of the second elevator shaft and the two transfer devices advantageously allows for a continuous operation of the elevator system. The transfer devices are arranged particularly in the area of the end positions of the elevator cars. For example, if an elevator car reaches the upper end position in case of an upward movement in the first elevator shaft, it is horizontally displaced to the upper end position of the second elevator shaft by means of the upper transfer device after all passengers have left the elevator car and it has decoupled itself from the support means. Subsequently, it can couple itself to a support means in the second elevator shaft and thus be moved in a downward direction in the second elevator shaft to the lower end position. From there, it is once again displaced horizontally by the lower transfer device to the lower end position of the first elevator shaft, from which it can be moved again in an upward direction. In this case, particularly a plurality, for example, four elevator cars per elevator shaft can be moved simultaneously, wherein only one elevator car is coupled to one support means at a time. This allows for a particularly effective operation of the elevator system.

The transfer devices can be designed particularly in accordance with the transfer devices in the form of horizontal displacement units of EP 2219985 B1. In this case, the transfer device has a vertical guide rail piece that guides the elevator car in the transfer device. The transfer device is positionable such that the guide rail piece forms a section of a vertical guide rail, by which the elevator car is guided during a movement in an elevator shaft. The elevator car also has a braking device, with which the elevator car can be temporarily fastened to the guide rail piece, which is integrated in the transfer device, during the displacement between the elevator shafts.

In an embodiment of the invention, an equal number of support means with two coupling elements each are arranged in the first elevator shaft and in the second elevator shaft. A number of the elevator cars is at most equal to a total number of the support means of the elevator system. The number of elevator cars is particularly exactly equal to the total number of support means. This means that the number of coupling elements per elevator shaft is greater than or equal to the number of elevator cars to be moved in an elevator shaft. As a result, each elevator car in each of the two elevator shafts can be assigned a specific coupling element or, in the case of a simultaneous coupling to two support means, two coupling elements can be assigned, wherein the respective coupling elements are arranged in the two elevator shafts at the same position. In this context, an assignment is supposed to refer to the fact that an elevator car couples via its coupling device exclusively to the associated coupling element or elements. Each elevator car thus requires only one coupling device or, in case of a simultaneous coupling to two coupling elements, only two coupling devices, which are each arranged in a fixed position. The coupling devices are thus not movable transversely to the actuating direction of the bolts of the coupling devices. This allows for a cost-effective realization of the coupling devices. In this case, the coupling device also requires very little installation space.

For example, in case of two support means (a left and a right support means) and thus four coupling elements (one left, primary and one right, secondary coupling element per support means) per elevator shaft, the left coupling element of the left support means can be assigned to the first elevator car, the left coupling element of right support means can be assigned to the second elevator car, the right coupling element of the left support means can be assigned to the third elevator car, and the right coupling element of the right support means can be assigned the fourth elevator car. These assignments are identical in both elevator shafts. The coupling element associated with an elevator car is thus arranged in the same position in both elevator shafts. For example, the first elevator car thus requires only one coupling device, which is positioned such that it can only be coupled to the left coupling element of the left support means.

In an embodiment of the invention, the support means are designed as belts. Belts have excellent traction properties and are particularly well-suited to interact with controllable coupling devices. The belts can be designed, e.g., as flat belts, V-ribbed belts, or toothed belts, and can be reinforced with tensile reinforcements in the form of wire cables, synthetic fiber cables, or synthetic fiber fabrics. As a result, an elevator car coupled to the support means can be moved over a great height without the occurrence of undue vertical vibrations.

However, it is also possible that the support means consists of one or more cables, particularly wire cables.

In an embodiment of the invention, the coupling elements are guided in the elevator shaft in case of a movement. The guide used for this purpose is particularly designed such that it prevents the coupling elements from striking against a passing elevator car. This allows for a particularly comfortable and safe operation of the elevator system. In case of a movement of an elevator car in the elevator shaft, it cannot be completely ruled out that the support means and thus the coupling element not connected to an elevator car is caused to vibrate. Without a guide of the coupling element, there would particularly be the risk of the coupling element striking against the passing elevator car. Such a striking would lead to an audible blow and could also cause damage to the elevator car and/or the coupling element. This risk is prevented by the guide of the coupling elements.

In an embodiment of the invention, each elevator car has two coupling devices. These are provided to simultaneously couple to coupling elements of two different support means. The drive machines of the two support means are controlled in a synchronized manner, and so both support means are driven and moved in a synchronized manner. The two coupling devices of an elevator car are arranged particularly on opposite sides of the elevator car. They are provided particularly to be coupled at diagonally opposite positions to one respective coupling element of a support means. This allows for a particularly even or evenly distributed force application into the elevator car, which allows for a very small tilting of the elevator car during movement. As a result, a comfortable moving of the elevator car is possible and the guides of the elevator car are only slightly stressed, which allows for a simple and more cost-efficient design and also leads to very low wear. In addition, only about half the force must be applied via a coupling device when compared to only one coupling device per elevator car. This allows for the use of more cost-efficient drive machines, which also require only a small installation space.

For that purpose, the two coupling devices are particularly not mechanically coupled, but are correspondingly controlled by the elevator controller. When coupled to the two support means, the coupling devices are particularly positioned such that a connecting line runs at the height of the center of gravity of the elevator car between the two coupling elements of the support means through said center of gravity. This allows for a particularly even force application into the elevator car.

It is also possible that each elevator car has only a single coupling device. The elevator car can then only be coupled to one support means and be moved in the elevator shaft by means of said support means.

Further advantages, features, and details of the invention can be derived using the following description of embodiments and the drawings, in which identical or functionally identical elements are denoted with identical reference signs. The drawings are merely schematic and not to scale.

DETAILED DESCRIPTION

Figure 1:
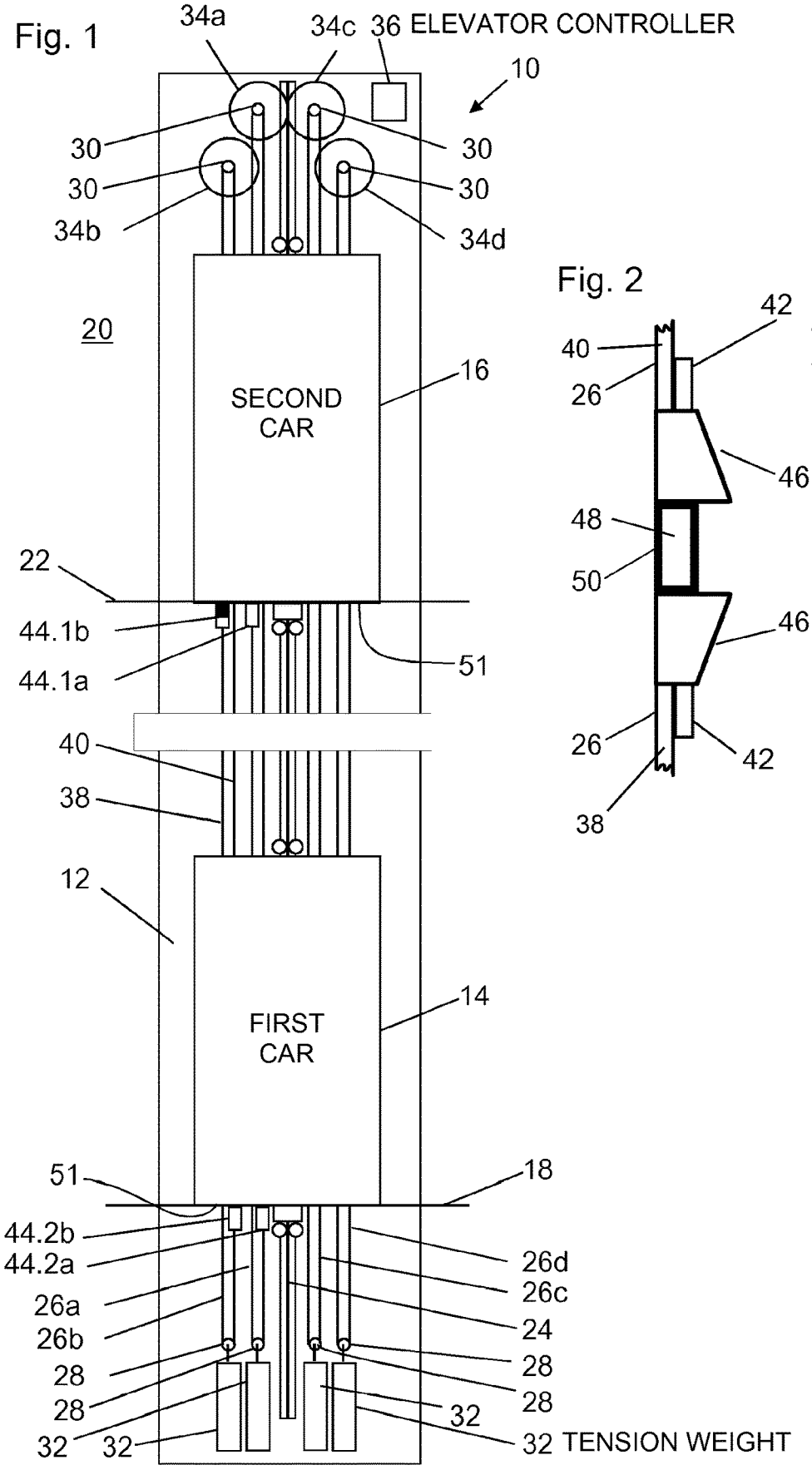
FIG. 1 shows a first elevator shaft of an elevator system with a first and a second elevator car, which can be coupled to the support means and can be decoupled from said support means.

According to FIG. 1, an elevator system 10 has a first elevator shaft 12, in which a first elevator car 14 and a second elevator car 16 are arranged. The first elevator car 14 is located at a lower end position 18 which corresponds to a position of the elevator car 14 at a lowest floor of the building 20 having the elevator system 10. The second elevator car 16 is located at an upper end position 22, which corresponds to a position of the elevator car 16 at a top floor of the building 20. Between the lower end position 18 and the upper end position 22 are a multiplicity of floors, which are not shown in FIG. 1.

The elevator system 10 has a vertically running vertical guide rail 24, on which the elevator cars 14, 16 are guided during a movement in the elevator shaft 12. For moving the elevator cars 14, 16 in the elevator shaft 12, the elevator system 10 comprises a total of eight closed support means, wherein FIG. 1 shows four of said support means 26*a*, 26*b*, 26*c*, 26*d*. The support means 26*a*, 26*b*, 26*c*, 26*d* are designed as belts and are each guided about a lower deflection roller 28 and an upper deflection roller 30.

The two deflection rollers 28, 30 of a support means 26*a*, 26*b*, 26*c*, 26*d* are arranged vertically one above the other, and so the support means 26*a*, 26*b*, 26*c*, 26*d* run vertically between the deflection rollers 28, 30. The deflection rollers 28, 30 have particularly an effective diameter of less than 100 mm. The lower deflection rollers 28 are arranged below the first elevator car 14 and are each connected to a tension weight 32. The tension weight 32 acts as a tensioning device, with which the required support means pretension is generated, and deviations in the initial length of the closed support means 26*a*, 26*b*, 26*c*, 26*d* as well as operational plastic changes in length of the support means 26*a*, 26*b*, 26*c*, 26*d* are compensated.

The upper deflection rollers 30 are arranged above the second elevator car 16 and are each used as a propulsion disk for each drive machine 34*a*, 34*b*, 34*c*, 34*d* designed as an electric motor. Each support means 26*a*, 26*b*, 26*c*, 26*d* is assigned a drive machine 34*a*, 34*b*, 34*c*, 34*d*, by means of which the support means 26*a*, 26*b*, 26*c*, 26*d* can be driven and moved. The drive machines 34*a*, 34*b*, 34*c*, 34*d* are controlled by an elevator controller 36, which controls all the actuators of the elevator system 10.

Figure 2:
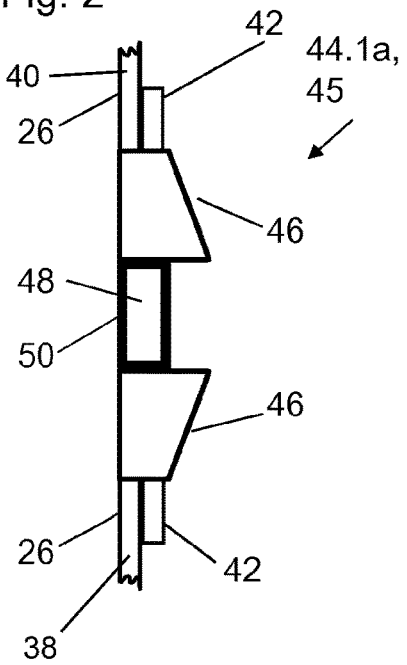
FIG. 2 shows an enlarged view of a coupling element of a support means from FIG. 1.

Each support means 26*a*, 26*b*, 26*c*, 26*d* consists of two support means parts 38, 40, whose free ends 42 (see FIG. 2) are connected by means of a primary coupling element and a secondary coupling element. For that purpose, one free end 42 of the first support means part 38 is connected to a free end of the second support means part 40, and so each support means 26*a*, 26*b*, 26*c*, 26*d* forms a closed ring. A coupling element can thus also be called a connection element 45 (see FIG. 2). FIG. 1 only shows the first primary coupling element 44.1*a* and the first secondary coupling element 44.2*a* of the first support means 26*a*, as well as the second primary coupling element 44.1*b* and the second secondary coupling element 44.2*b* of the second support means 26*b*. As an example of the identically designed coupling elements, the first primary coupling element 44.1*a* is shown enlarged in FIG. 2. The coupling element 44.1*a* and thus the connection element 45 consists of two support means end connections 46 which are aligned in the opposite direction and connected to an intermediate piece 50 with a recess 48. The intermediate piece 50 has a mainly cuboid outer contour. The support means end connections 46 can be designed, for example, according to the support means end connections described in EP 1634842 A2. An extendable bolt 60 (see FIG. 4) of a coupling device arranged on an elevator car 14, 16 (see, e.g., coupling device 58*b* in FIG. 4) can be inserted into the recess 48, thus coupling the coupling device to the coupling element. By pulling the bolt 60 out of the recess 48, the coupling device can decouple from the coupling element. The coupling devices are arranged on a floor 51 of the elevator cars 14, 16 and shall be described in more detail in connection with FIG. 4. In the drawings, a coupling element 44.1*a*, 44.1*b*, 44.2*a*, 44.2*b*, to which a coupling device has been coupled, has a filled-in square. In FIG. 1, the second elevator car 16 is thus connected via the coupling element 44.1*b* to the second support means 26*b* which in FIG. 1 is arranged on the far left side.

It is also possible that the coupling devices are arranged on the roof of an elevator car. The positions of the coupling elements on the support means must then be adjusted accordingly.

Once an elevator car 14, 16 is coupled to a coupling element 44.1*a*, 44.1*b*, 44.2*a*, 44.2*b* via its associated coupling device, a drive connection between the elevator car 14, 16 and the support means 26*a*, 26*b* is produced. In this coupled state, the elevator car 14, 16 is carried along by the support means 26*a*, 26*b* and thus moved in the elevator shaft 12 when the support means 26*a*, 26*b* is driven or moved by the associated drive machine 34*a*, 34*b*. In the state shown in FIG. 1, the second elevator car 16 can thus be moved in the elevator shaft 12. Since the first elevator car 14 in FIG. 1 is not coupled to a support means 26*a*, 26*b*, 26*c*, 26*d*, a movement of the first elevator car 14 in the elevator shaft 12 is not possible in the state shown in FIG. 1.

Figure 3:
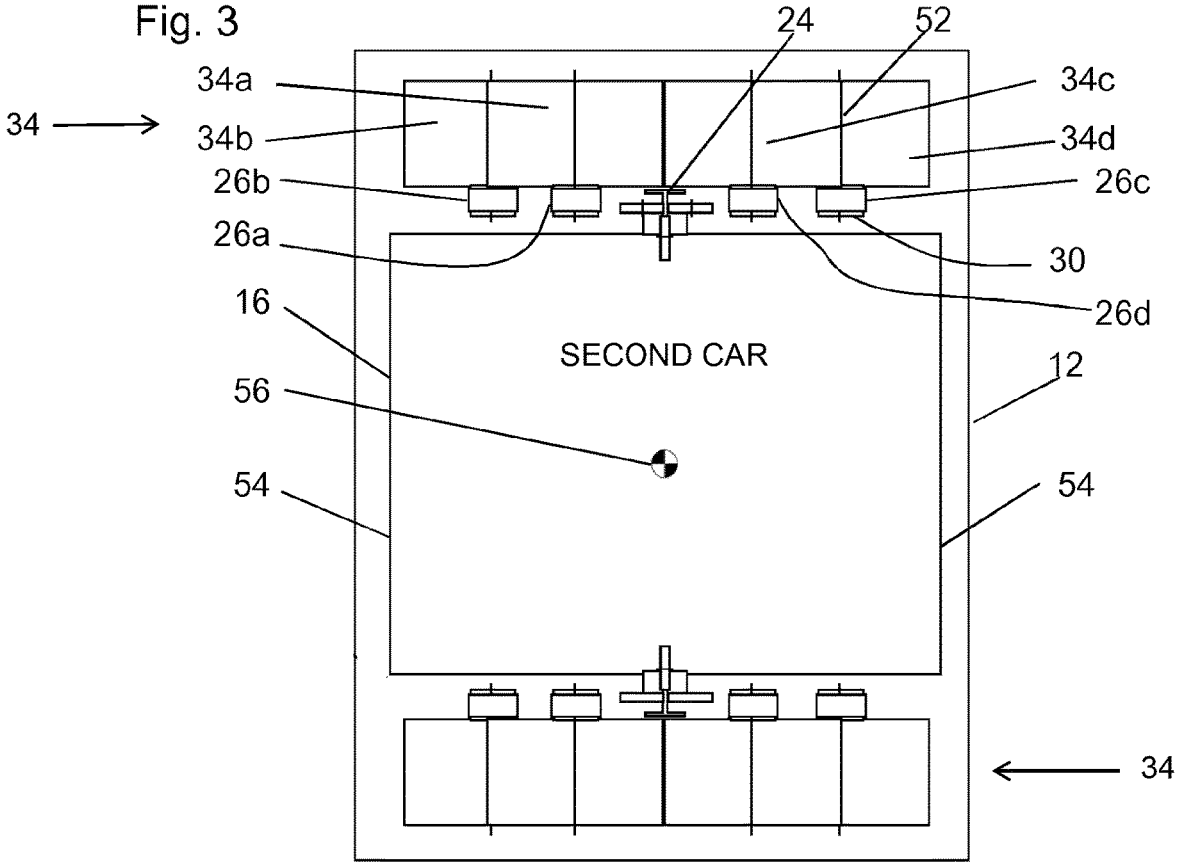
FIG. 3 shows a top view of the first elevator shaft of the elevator system in FIG. 1 with a total of eight driving machines.

FIG. 3 shows a top view of the first elevator shaft 12 with a total of eight drive machines 34. The drive machines 34*a*, 34*b*, 34*c*, 34*d* are each drive-connected to a propulsion disk in the form of a deflection roller 30, over which one support means 26*a*, 26*b*, 26*c*, 26*d* runs. For reasons of clarity, the reference signs in FIG. 3 are shown only for one side. Four drive machines 34*a*, 34*b*, 34*c*, 34*d* are each arranged on opposite sides of the elevator car 16, wherein on each of the opposite sides of the elevator car 16, two drive machines 34*a*, 34*b* are arranged on one side and two drive machines 34*c*, 34*d* on the other side of the vertical guide rail 24. Drive axles 52 of the drive machines 34*a*, 34*b*, 34*c*, 34*d* run parallel to one another, wherein a respective drive machine 34*a*, 34*b*, 34*c*, 34*d* is arranged on one side of the elevator car 16 coaxially to a corresponding drive machine on the other side of the elevator car 16. On one or both free sides 54 of the elevator car 16, on which no drive machines 34*a*, 34*b*, 34*c*, 34*d* are arranged, a car door (not depicted) of the elevator car 16 is located.

The elevator controller 36 similarly or synchronously controls two corresponding drive machines on opposite sides, and so their associated support means 26*a*, 26*b*, 26*c*, 26*d* also move synchronously or are moved synchronously. Two drive machines are controlled in the same way, which are arranged diagonally with respect to a center of gravity 56 of the elevator car 16, i.e., for example, in FIG. 3, the upper, leftmost drive machine 34*b* and the lower, rightmost drive machine. With the eight drive machines 34*a*, 34*b*, 34*c*, 34*d*, a total of four elevator cars can thus be moved simultaneously and independently of one another in the first elevator shaft 12.

Figure 4:
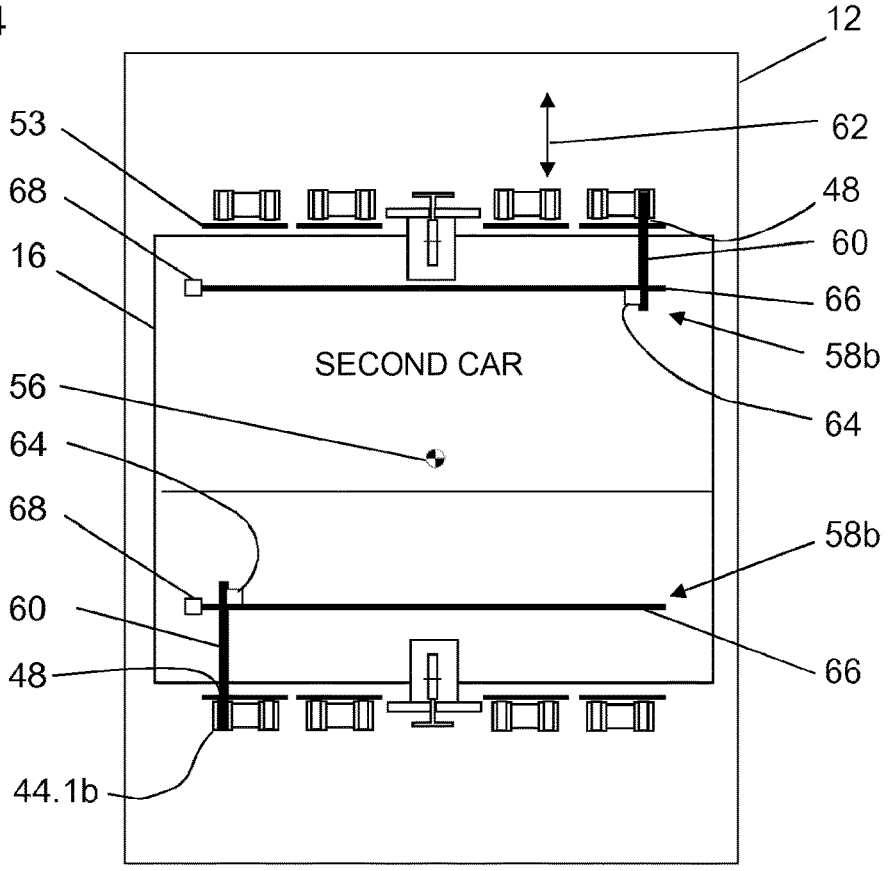
FIG. 4 shows a bottom view of an elevator car of the elevator system in FIG. 1 with two coupling devices for coupling to and decoupling from coupling elements of the support means.

FIG. 4 shows a bottom view of the elevator car 16 with two coupling devices 58*b* for coupling to two coupling elements of the support means. In FIG. 4, the coupling devices 58*b* are coupled to the two primary coupling elements 44.1*b* of the second support means. The coupling devices 58*b* are each arranged opposite of the drive machines 34*a*, 34*b*, 34*c*, 34*d* (not shown in FIG. 4), and thus opposite of the coupling elements of the support means. Each coupling device 58*b* has a bolt 60 which can be extended and retracted in an actuating direction 62 which is oriented in the direction of the coupling elements 44.1*b*. For extending and retracting the bolt 60, the coupling device 58*b* has an actuator 64, which can be designed, for example, as an electric motor. For positioning the bolt 60 opposite of the coupling elements 44.1*b*, the bolt 60 together with the actuator 64 can be displaced horizontally and perpendicularly to the actuating direction 62 along a rail 66 by means of a positioning actuator 68, which, for example, is also designed as an electric motor.

For coupling a coupling device 58*b* and thus the elevator car 16 to a coupling element 44.1*b* and thus to the second support means, the bolt 60 is first correctly positioned with respect to the corresponding coupling element 44.1*b*. Subsequently, the bolt 60 is extended, whereby the bolt 60 is inserted into the recess 48 of the coupling element 44.1*b*. This produces an interlocking connection between the coupling device 58*b* and the coupling element 44.1*b* and thus between the elevator car 16 and the second support means. Once this interlocking connection is produced, the elevator car 16 is moved in the elevator shaft 12 as soon as the second support means is driven or moved by the drive machine 34*b*.

As already described in connection with FIG. 3, the elevator car 16 is coupled to two support means, which are arranged diagonally with respect to the center of gravity 56 of the elevator car. This is achieved in that the elevator car 16 is coupled to coupling elements 44.1*b*, which are arranged diagonally with respect to the center of gravity 56 of the elevator car 16.

During the movement in the elevator shaft 12, each coupling element 44.1*a*, 44.1*b*, 44.2*a*, 44.2*b* is guided by a guide 53. The guide 53 is arranged between each coupling element 44.1*a*, 44.1*b*, 44.2*a*, 44.2*b* and the elevator car 16 and runs through the entire elevator shaft 12. The guides 53 particularly prevent a striking of a free coupling element 44.1*a*, 44.1*b*, 44.2*a*, 44.2*b*, i.e., a coupling element 44.1*a*, 44.1*b*, 44.2*a*, 44.2*b* not coupled to an elevator car 14, 16, against a passing elevator car 14, 16.

It is also possible that the bolts of the coupling devices are not slidable transversely to the actuating direction. In this case, the coupling devices have separate bolts and actuators for each coupling element.

It is also possible that an elevator car has only one coupling device, and so, for moving in the elevator shaft, an elevator car is coupled to only one support means. This is the case particularly when the drive machines and thus the support means are arranged on a side of the elevator cars which is opposite of the car door and thus the shaft doors.

Figures 5A, 5B, 5C:
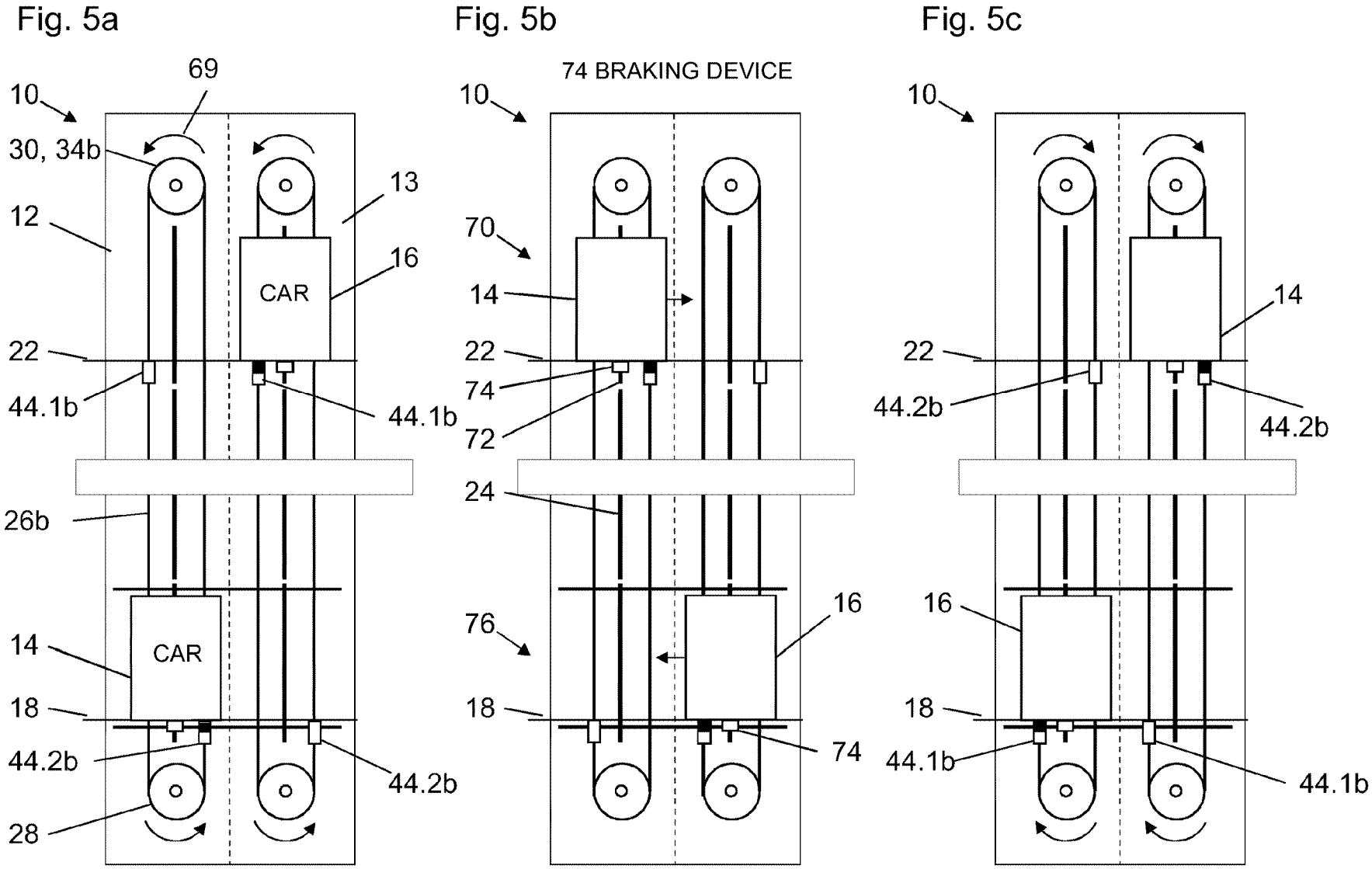
FIGS. 5*a*-5*c* show a greatly simplified depiction of an elevator system according to FIG. 1 with two elevator shafts, two transfer devices, and two elevator cars with different positions of the elevator cars to illustrate the operating principle of the elevator system.

The drawings in FIGS. 5*a*, 5*b*, and 5*c* describe in more detail the operating principle of the elevator system 10 and particularly the arrangement of the primary and secondary coupling elements 44.1*b*, 44.2*b* of the second support means 26*b*. For reasons of clarity, only one upper and one lower area of the elevator system 10 and only the second support means 26*b* are shown per elevator shaft in FIGS. 5*a*, 5*b*, and 5*c*. In addition, the deflection rollers 28, 30 are shown with a larger diameter when compared to FIG. 1.

In addition to a first elevator shaft 12, the elevator system 10 according to FIGS. 5*a*, 5*b*, and 5*c* has a second elevator shaft 13 which is arranged parallel to the first elevator shaft 12. The second elevator shaft 13 is designed analogously to the first elevator shaft 12. The movement of the elevator cars 14, 16 in the second elevator shaft 13 is realized analogously to the movement in the first elevator shaft 12. In the first elevator shaft 12, the elevator cars 14, 16 are moved only in an upward direction, and in the second elevator shaft 13, they are moved only in a downward direction.

In FIG. 5*a*, the first elevator car 14 is located in the first elevator shaft 12 at the lower end position 18. It is coupled via its coupling device (not depicted in FIGS. 5*a*, 5*b*, and 5*c*) to a secondary coupling element 44.2*b* of the second support means 26*b*, said coupling element 44.2*b* being the right one in FIG. 5*a*. In this case, the first elevator car 14 has only a single, non-slidable coupling device. The coupling device is arranged such that it can be coupled to the secondary coupling element 44.2*b*. The first elevator car 14 can thus only be coupled to the secondary coupling element 44.2*b*, and so the first elevator car 14 is assigned the secondary coupling element 44.2*b*.

A second primary coupling element 44.1*b* (on the left in FIG. 5*a*) of the second support means 26*b* is arranged on the second support means 26*b* such that a coupling device of an elevator car located at the upper end position 22 could decouple from the primary coupling element 44.1*b*. One deflection roller 28, 30 is each arranged between the secondary coupling element 44.2*b* and the primary coupling element 44.1*b* of the second support means 26*b*.

For moving the first elevator car 14 upwards, the driving machine 34*b* drives the upper deflecting roller 30 in a counterclockwise movement direction, indicated by a directional arrow 69. With possible intermediate stops on floors between the lower end position 18 and the upper end position 22, the first elevator car 14 is moved to the upper end position 22. Simultaneously with the upward movement of the secondary coupling element 44.2*b* (on the right in FIG. 5*a*), the primary coupling element 44.1*b* (on the left in FIG. 5*a*) is moved in a downward direction. During said movement, neither of the two coupling elements 44.1*b*, 44.2*b* comes into contact with one of the two deflection rollers 28, 30. The coupling elements 44.1*b*, 44.2*b* thus neither touch either of the two deflection rollers 28, 30 nor are they guided about the deflection rollers 28, 30.

In FIG. 5*a*, the second elevator car 16 is located in the second elevator shaft 13 at the upper end position 22. It is coupled via its coupling device (not depicted in FIGS. 5*a*, 5*b*, and 5*c*) to a primary coupling element 44.1*b* (on the left in FIG. 5*a*) of the second support means 26*b*. The second elevator car 16 also has only a single, non-slidable coupling device. The coupling device is arranged such that it can be coupled to the primary coupling element 44.1*b*. The second elevator car 16 can thus only be coupled to the primary coupling element 44.1*b*, and so the second elevator car 16 is assigned the primary coupling element 44.1*b*.

A secondary coupling element 44.2*b* (on the right in FIG. 5*a*) of the second support means 26*b* is arranged on the second support means 26*b* such that a coupling device of an elevator car located at the lower end position 18 could decouple from the secondary coupling element 44.2*b*. One deflection roller 28, 30 each is arranged between the primary coupling element 44.1*b* and the secondary coupling element 44.2*b* of the second support means 26*b*.

For moving the second elevator car 16 in a downward direction, the drive machine 34*b* also drives the upper deflection roller 30 in the counterclockwise direction. With possible intermediate stops on floors between the upper end position 22 and the lower end position 18, the second elevator car 16 is moved to the lower end position 18. Simultaneously with the downward movement of the primary coupling element 44.1*b* (on the left in FIG. 5*a*), the secondary coupling element 44.2*b* (on the right in FIG. 5*a*) is moved in an upward direction. During said movement, neither of the two coupling elements 44.1*b*, 44.2*b* comes into contact with one of the two deflection rollers 28, 30.

FIG. 5*b* shows the situation when the first elevator car 14 in the first elevator shaft 12 has reached the upper end position 22 and the second elevator car 16 in the second elevator shaft 13 has reached the lower end position 18. Since the elevator cars 14, 16 in the first elevator shaft 12 are moved only upwards and only downwards in the second elevator shaft 13, both elevator cars 14, 16 must execute a shaft change.

For executing shaft changes, the elevator system 10 has a first, upper transfer device 70, by means of which the first elevator car 14 can be displaced at the upper end position 22 from the first elevator shaft 12 to the second elevator shaft 13. The first transfer device 70 has a vertical guide rail piece 72 which guides the first elevator car 14 in the first transfer device 70. Before the beginning of the displacement, the first transfer device 70 is positioned such that the guide rail piece 72 forms a section of the vertical guide rail 24 of the first elevator shaft 12, by means of which the first elevator car 14 is guided during a movement in the first elevator shaft 12. The first elevator car 14 has a braking device 74, with which the first elevator car 14 is temporarily fastened to the guide rail piece 72, which is integrated in the first transfer device 70, during the displacement between the first elevator shaft 12 and the second elevator shaft 13.

The elevator system 10 also has a second, lower transfer device 76 for displacing the second elevator car 16 in the lower end position 18 from the second elevator shaft 13 to the first elevator shaft 12. The second, lower transfer device 76 is designed analogously to the first, upper transfer device 70. The second elevator car 16 also has a braking device 74.

The transfer devices 70, 76 can be designed particularly in accordance with the transfer devices in the form of horizontal displacement units of EP 2219985 B1.

FIG. 5*c* shows the situation after the displacement of the two elevator cars 14, 16. The first elevator car 14 is positioned in the second elevator shaft 13 at the upper end position 22, and the second elevator car 16 is positioned in the first elevator shaft 12 at the lower end position 18.

The second elevator car 16 currently arranged in the first elevator shaft 12 at the lower end position 18 is now coupled via its coupling device to the primary coupling element 44.1*b* (on the left in FIG. 5*c*) of the second support means 26*b*. The secondary coupling element 44.2*b* (on the right in FIG. 5*c*) of the second support means 26*b* is arranged on the second support means 26*b* such that a coupling device of an elevator car located at the upper end position 22 could decouple from the secondary coupling element 44.2*b*.

For moving the second elevator car 16 upwards, the drive machine 34*b* now drives the upper deflection roller 30 in the clockwise direction. The drive machine 34*b* is thus controlled by the elevator controller such that the movement direction of the second support means 26*b* is reversed for the next movement of an elevator car when an elevator car has reached the lower end position or the upper end position.

With possible intermediate stops on floors between the lower end position 18 and the upper end position 22, the second elevator car 16 is moved to the upper end position 22. Simultaneously with the upward movement of the primary coupling element 44.1*b* (on the left in FIG. 5*c*), the secondary coupling element 44.2*b* (on the right in FIG. 5*c*) is moved in a downward direction.

In FIG. 5*c*, the first elevator car 14 is located in the second elevator shaft 13 at the upper end position 22. It is coupled via its coupling device to the secondary coupling element 44.2*b* (on the right in FIG. 5*c*) of the second support means 26*b*. The primary coupling element 44.1*b* (on the left in FIG. 5*c*) of the second support means 26*b* is arranged on the second support means 26*b* such that a coupling device of an elevator car located at the lower end position 18 could decouple from the secondary coupling element 44.1*b*.

For moving the first elevator car 14 in a downward direction, the drive machine 34*b* now drives the upper deflection roller 30 also in the clockwise direction. In comparison to FIG. 5*a*, there is thus also a reversal of the movement direction of the second support means 26*b*. With possible intermediate stops on floors between the upper end position 22 and the lower end position 18, the first elevator car 14 is moved to the lower end position 18. Simultaneously with the downward movement of the secondary coupling element 44.2*b* (on the right in FIG. 5*c*), the primary coupling element 44.1*b* (on the left in FIG. 5*c*) is moved in an upward direction.

According to the model shown in FIGS. 5*a*-5*c*, four elevator cars per elevator shaft and thus a total of eight elevator cars can be moved simultaneously in the vertical direction in the elevator system according to FIGS. 1-4.

It is also possible for the elevator system to have a third elevator shaft, in which elevator cars can be parked which are currently not needed.

Figure 6:
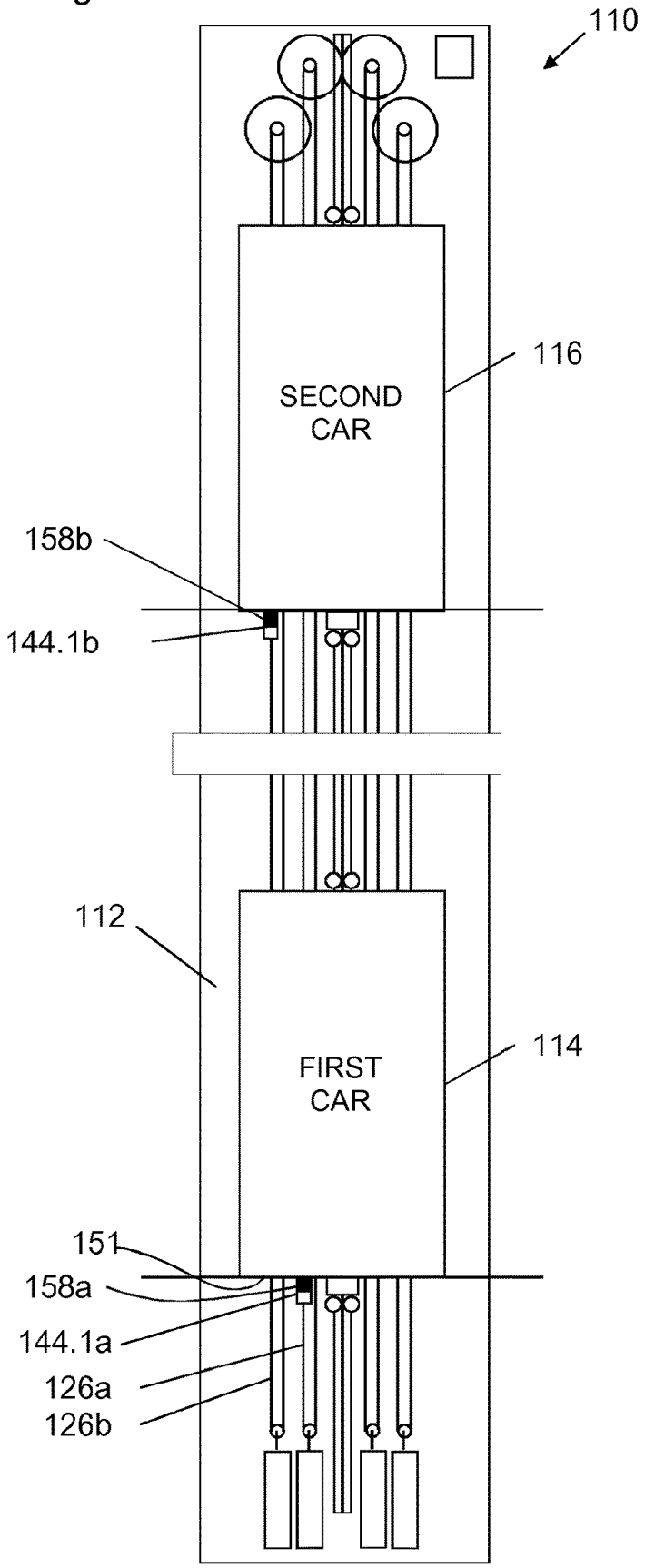
FIG. 6 shows a single elevator shaft of an elevator system with a first and a second elevator car which are firmly coupled to support means.
Figure 7:
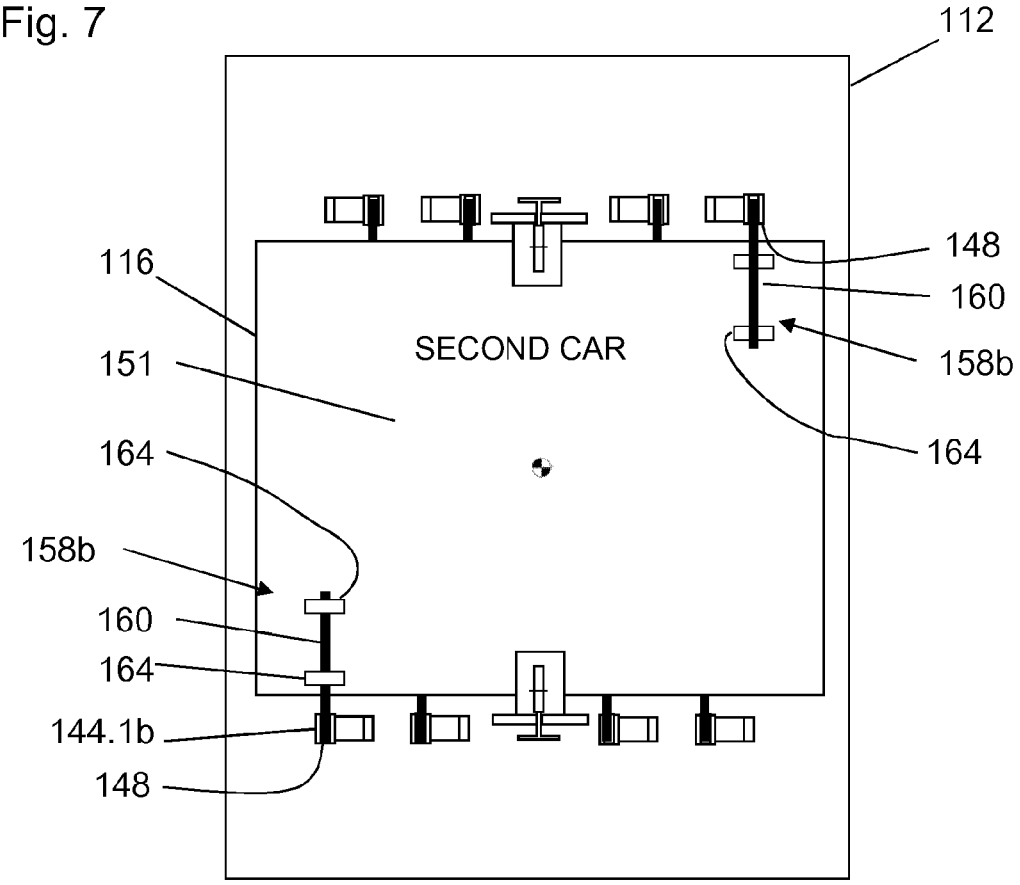
FIG. 7 shows a bottom view of an elevator car of the elevator system in FIG. 6 with two coupling devices for a firm coupling to coupling elements of two support means.

FIGS. 6 and 7 show an elevator system 110 with only a single elevator shaft 112. The elevator system 110 in FIGS. 6 and 7 is designed similarly to the elevator system 10 according to FIGS. 1-5*c*, and so only the differences between the elevator system 110 and the elevator system 10 shall be described.

The elevator system 110 in FIG. 6 has a total of four independently movable elevator cars, wherein only a first, lower elevator car 114 and an upper, second elevator car 116 are shown. The first elevator car 114 is coupled via a first coupling device 158*a* and a first primary coupling element 144.1*a* to a first support means 126*a*. The second elevator car 116 is coupled via a second coupling device 158*b* and a second primary coupling element 144.1*b* to a second support means 126*b*. For that purpose, the coupling is designed such that it cannot be disengaged during a normal operation of the elevator system 110, i.e., said coupling devices cannot be decoupled from the coupling elements. During normal operation of the elevator system 110, there is thus always a drive connection between an elevator car and the associated support means.

The four elevator cars can thus be moved independently of one another in the elevator shaft 112.

As shown in FIG. 7, a bolt 160 of the second coupling device 158*b* is inserted into a recess 148 of the second primary coupling element 144.1*b*. The bolt 160 is securely fastened to the floor 151 of the second elevator car 116 via two U-shaped fastening elements 164 arranged at a distance from one another. The two fastening elements 164 are screwed to the floor 151 by means of screws (not depicted). The bolts 160, the fastening elements 164, and the screws thus form the coupling device 158*b*, which realize a coupling to the second primary coupling element 144.1*b*, which cannot be disengaged during normal operation of the elevator system 110.

Alternatively, the coupling element could also be screwed directly to the elevator car.

The elevator cars can also be held by a mainly L-shaped frame which is guided and driven. Such a design is also called a backpack arrangement.

Finally, it must be noted that terms such as "having," "comprising," etc. do not exclude any other elements or steps, and terms such as "an" or "a" do not exclude a multiplicity. It must further be noted that features or steps which have been described with reference to one of the above embodiments can also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system comprising:

a first elevator car movable in a first elevator shaft in a vertical direction;

a closed first support means guided about a lower deflection roller and an upper deflection roller in the first elevator shaft;

a first drive machine driving the first support means;

a first coupling device arranged on the first elevator car;

wherein the first support means has a first primary coupling element which, when coupled to the first coupling device, produces a drive connection between the first elevator car and the first support means whereby the first elevator car can be moved in the first elevator shaft by the first support means driven by the first drive machine;

wherein the first primary coupling element is a connection element that connects two free ends of the first support means together; and wherein during a normal operation of the elevator system the first coupling device can be coupled to the first primary coupling element and can be decoupled from the first primary coupling element whereby the drive connection between the first elevator car and the first support means can be produced and detached respectively.

2. The elevator system according to claim 1 including:

a second elevator car movable in the first elevator shaft in the vertical direction;

a closed second support means guided about another lower deflection roller and another upper deflection roller;

a second drive machine driving the second support means;

a second coupling device arranged on the second elevator car; and wherein the second support means has a second primary coupling element which, when coupled to the second coupling device, produces a drive connection between the second elevator car and the second support means whereby second elevator car can be moved in the first elevator shaft by the second support means driven by the second drive machine.

3. The elevator system according to claim 2 wherein each of the first and second support means has a secondary coupling element to and from which the first and second coupling devices can be coupled and decoupled, respectively, and the primary and secondary coupling elements of each of the first and second support means are arranged such that, in case of a movement of the elevator car coupled to one of the first and second support means from a lower end position to an upper end position, or vice versa, neither of the primary and secondary coupling elements of the one support means is guided about either of the deflection rollers associated with the one support means.

4. The elevator system according to claim 3 wherein the primary and secondary coupling elements of each of the first and second support means are arranged such that, in case of a movement of the elevator car coupled to one of the first and second support means, from the lower end position to the upper end position, or vice versa, neither of the primary and secondary coupling elements of the one support means contacts with either of the deflection rollers associated with the one support means.

5. The elevator system according to claim 3 wherein the primary and secondary coupling elements of each of the first and second support means are arranged such that, when the elevator car coupled to one of the support means via the primary coupling element has reached the upper end position, the secondary coupling element is positioned such that the coupling device of another of the elevator cars arranged in the lower end position can couple to the secondary coupling element.

6. The elevator system according to claim 3 wherein the first and second drive machines are controlled by an elevator controller that reverses a movement direction of the first and second support means for a next movement of the first and second elevator cars when the elevator cars have reached the lower end position or the upper end position.

7. The elevator system according to claim 2 wherein the first elevator car and the second elevator car are movable in the vertical direction in a second elevator shaft arranged parallel to the first elevator shaft, the elevator system having a first transfer device for displacing each of the elevator cars from the first elevator shaft to the second elevator shaft and a second transfer device for displacing the elevator cars from the second elevator shaft to the first elevator shaft, and wherein a movement of the elevator cars in the second elevator shaft is realized analogously to the movement of the elevator cars in the first elevator shaft.

8. The elevator system according to claim 7 wherein the elevator cars are moved only from a bottom to a top of the first elevator shaft, and only from a top to a bottom of the second elevator shaft.

9. The elevator system according to claim 7 wherein an equal number of support means, each having one primary coupling element and one secondary coupling element, are arranged in each of the first elevator shaft and the second elevator shaft, and a number of elevator cars movable in the first and second elevator shafts is at most equal to a total number of the support means.

10. The elevator system according to claim 1 wherein the first support means is a belt.

11. The elevator system according to claim 1 including a guide guiding the first primary coupling element in the first elevator shaft during movement of the first elevator car.

12. The elevator system according to claim 1 including a second coupling device arranged on the first elevator car whereby the first and second coupling devices simultaneously couple to coupling elements of two different support means.

13. The elevator system according to claim 12 wherein the first and second coupling devices are arranged on opposite sides of the first elevator car.

* * * * *